US006539874B2

(12) United States Patent
Weise

(10) Patent No.: US 6,539,874 B2
(45) **Date of Patent: *Apr. 1, 2003**

(54) CARTRIDGE

(75) Inventor: Thomas Weise, Unterlüss (DE)

(73) Assignee: TZN Forschungs-Und Entwicklungszentrum Unterlüss GmbH, Unterlüss (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/839,675

(22) Filed: Apr. 23, 2001

(65) Prior Publication Data

US 2001/0032563 A1 Oct. 25, 2001

(30) Foreign Application Priority Data

Apr. 22, 2000 (DE) ..... 100 20 020

(51) Int. Cl.[7] ..... F42B 5/08

(52) U.S. Cl. ..... 102/472; 102/430; 102/431; 102/202; 102/202.5; 102/202.9

(58) Field of Search ..... 102/430–433, 102/470, 472, 700, 202, 202.5, 202.7, 202.94, 202.14

(56) References Cited

U.S. PATENT DOCUMENTS 2,926,566 A * 3/1960 Atkins et al. ..... 102/472
4,763,577 A * 8/1988 Romer et al. ..... 102/431
5,052,302 A * 10/1991 Taddeo et al. ..... 102/470
5,231,242 A 7/1993 Chryssomallis et al. .... 102/472
5,287,791 A 2/1994 Chaboki et al. ..... 102/472
6,171,530 B1 * 1/2001 Haaland et al. ..... 264/3.2
6,309,484 B2 * 10/2001 Langlotz ..... 149/19.3
6,332,402 B1 * 12/2001 Weise et al. ..... 102/472
6,332,403 B1 * 12/2001 Weise et al. ..... 102/472
6,354,218 B1 * 3/2002 Weise et al. ..... 102/286

FOREIGN PATENT DOCUMENTS

| | | |
|---|---|---|
| DE | 198 34 058 A1 | 2/2000 |
| GB | 2 349 940 A | 11/2000 |
| WO | WO 00/17598 | 3/2000 |

* cited by examiner

*Primary Examiner*—Harold J. Tudor
(74) *Attorney, Agent, or Firm*—Venable; Norman N. Kunitz

(57) ABSTRACT

A cartridge having an electrothermal ignition device, in which, ignition conduits extend axially through a first propellant-charge powder (4) filling a cartridge sleeve (5), with the conduits essentially comprising an electrical wire (11–13) that is guided axially through a tube (14–16) comprising a second propellant-charge powder. Propellant-charge-powder tubes (14–16) comprising an optically transparent propellant-charge powder are used so that even cartridges (1) having a first propellant-charge powder (4) that is difficult to ignite can be ignited rapidly and reliably, requiring the smallest possible quantity of electrical energy.

10 Claims, 2 Drawing Sheets

CARTRIDGE

CROSS REFERENCE TO RELATED APPLICATION

This application is related to concurrently filed commonly owned U.S. application Ser. No. 09/839,674 corresponding to German Patent Application No. De 100 20 019.2 Filed Apr. 22, 2000.

BACKGROUND OF THE INVENTION

The invention relates to a cartridge having an electrothermal ignition device.

Significantly greater acceleration effects can be achieved for projectiles fired from guns with the use of high-energy propellant-charge powders, particularly NENA propellant-charge powder (NENA=N(2-nitroxy)nitraminethane) or DNDA propellant-charge powder (DNDA=dinitro-diaza-alkanes), than with conventional propellant-charge powders. Typically, the firing-gas temperature of such propellant-charge powders, and thus the barrel erosion, are lower than with other known powders. The high activation energy of the high-energy propellant-charge powders, however, impedes ignition with the aid of pyrotechnical ignition charges. The reduced ignitability of the propellant-charge powder also leads to an increase in the ignition delay times, and an increased scattering of the ignition times.

To assure a reliable, rapid ignition of a cartridge, e.g., with NENA propellant-charge powder, it has proven advantageous to employ an electrothermal ignition device instead of a pyrotechnical ignition charge. In this case, a high current flows through a wire-type conductor in the floor-side region of the corresponding cartridge such that the conductor vaporizes explosively and generates a high-energy arc. This arc then ignites the corresponding propellant-charge powder.

As the Applicant's experiments have revealed, in this type of electrothermal ignition device, the relatively heavy dependency of NENA propellant-charge powder on temperature, which leads to a corresponding dependency on the acceleration effect, can be compensated with the quantity of electrical energy supplied to the plasma-ignition system.

A drawback of this electrothermal ignition device is that the generation of the floor-side or base-side arc only effects the ignition of a relatively small percentage of the propellant-charge powder, and, often, no reproducible combustion behavior of the propellant-charge powder results, This is particularly true with propellant-charge powders that are difficult to ignite.

To obtain a reproducible combustion behavior of the propellant-charge powder, German patent Application DE 199 21 379.8, corresponding with Patent Application GB 2,349,940, published Nov. 15, 2000, proposes disposing the wire-type conductors inside tubes also comprising propellant-charge powder extending through the propellant charge, rather than leading the wire-type conductors directly through the propellant-charge. These propellant-charge-powder tubes then constitute ignition conduits inside the propellant-charge structure. In the activation of the ignition device, first the wire-type conductor vaporizes and an arc plasma conduit forms inside the respective propellant-charge-powder tubes. Radiation-transport mechanisms transport the energy to the environment by way of the plasma conduits. This energy transport leads to a rapid ignition of the propellant-charge-powder tubes and their fragmentation. The burning fragments (hot spots) of the propellant-charge-powder tubes, and the released arc radiation, effect a rapid, uniform ignition of the propellant-charge structure.

It has been seen, however, that, in the use of propellant-charge-powder tubes comprising graphitized propellant-charge powder, which is widely available commercially, a relatively large amount of electrical energy is necessary for attaining an adequate ignition interaction with the propellant-charge powder.

In view of the not-previously-published German patent application document DE 199 21 379.8, it is the object of the invention to disclose a cartridge in which even propellant-charge powders that are difficult to ignite, particularly NENA or DNDA propellant-charge powders, can be ignited rapidly and reliably with the smallest possible requirement of electrical energy.

SUMMARY OF THE INVENTION

The above object generally is achieved according to the present invention by a cartridge with an electrothermal ignition device, which comprises a cartridge including a combustible sleeve that is at least partially filled with a first propellant-charge powder, and a metal base connected to one end of the sleeve and forming the base of the cartridge. A high-voltage electrode extends through and is insulated from the base, and an electrically-conductive wire, which extends axially through the first propellant-charge powder, has a first end connected to the high-voltage electrode and a second end connected to an electrical contact disposed in the forward region of the propellant-charge sleeve for contacting the inner wall of a gun barrel when the cartridge is fired. The electrically-conductive wire is guided axially through a tube that is formed of a second propellant-charge powder and that is disposed in the first propellant charge powder along at least an axial portion of the propellant-charge sleeve. The second propellant-charge powder forming the tube is an optically transparent propellant-charge powder.

Further advantageous embodiments of the invention are disclosed.

The invention is essentially based on the concept of using transparent propellant-charge-powder tubes. Nitrocellulose powder, particularly the type known as JA2, has proven especially effective as a propellant-charge powder. To assure the transparency of this propellant-charge powder, it cannot contain any black components, and the conventional graphitization of the outside surface must be omitted.

The use of optically transparent propellant-charge-powder tubes permits the radiation emitted by the plasma conduits to reach the propellant-charge structure of the cartridge without large absorption losses. Furthermore, the plasma radiation effects a change in the combustible surface of the transparent propellant-charge-powder tubes, which leads to a significantly accelerated conversion of the tubes, and thus supports the ignition process. The utilization of these properties results in a distinct reduction in the requirement of electrical energy for the plasma-ignition system.

It has also been seen that, with the use of optically transparent propellant-charge-powder tubes, the requirement for additional electrical energy for the temperature compensation of the NENA propellant-charge powder is reduced in comparison to that of non-transparent tubes.

With the use of DNDA propellant-charge powder, this additional electrical energy can be omitted, because the DNDA propellant-charge powder burns extensively independently of the temperature.

Further details and advantages of the invention ensue from the exemplary embodiment described below in conjunction with drawing figures.

DETAILED DESCRIPTION OF THE PREFERRED EMBODIMENTS

Figure 1:
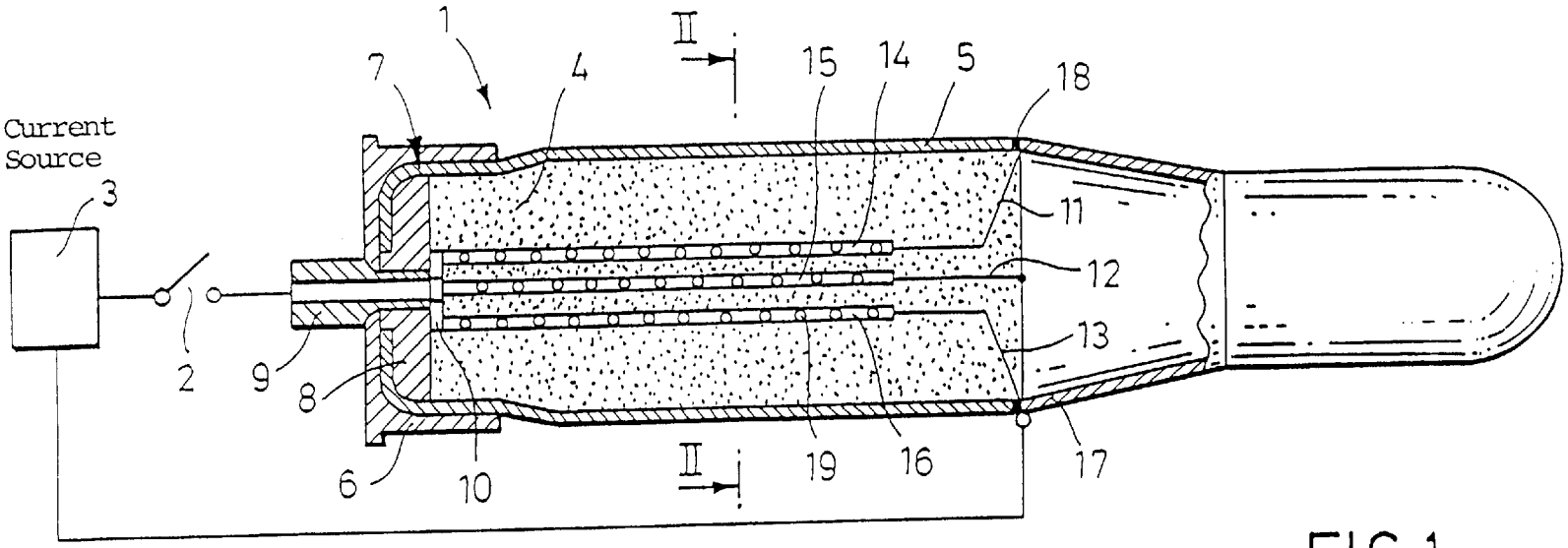
FIG. 1 is a longitudinal section through an exemplary embodiment of a cartridge according to the invention, having three ignition conduits.
Figure 2:
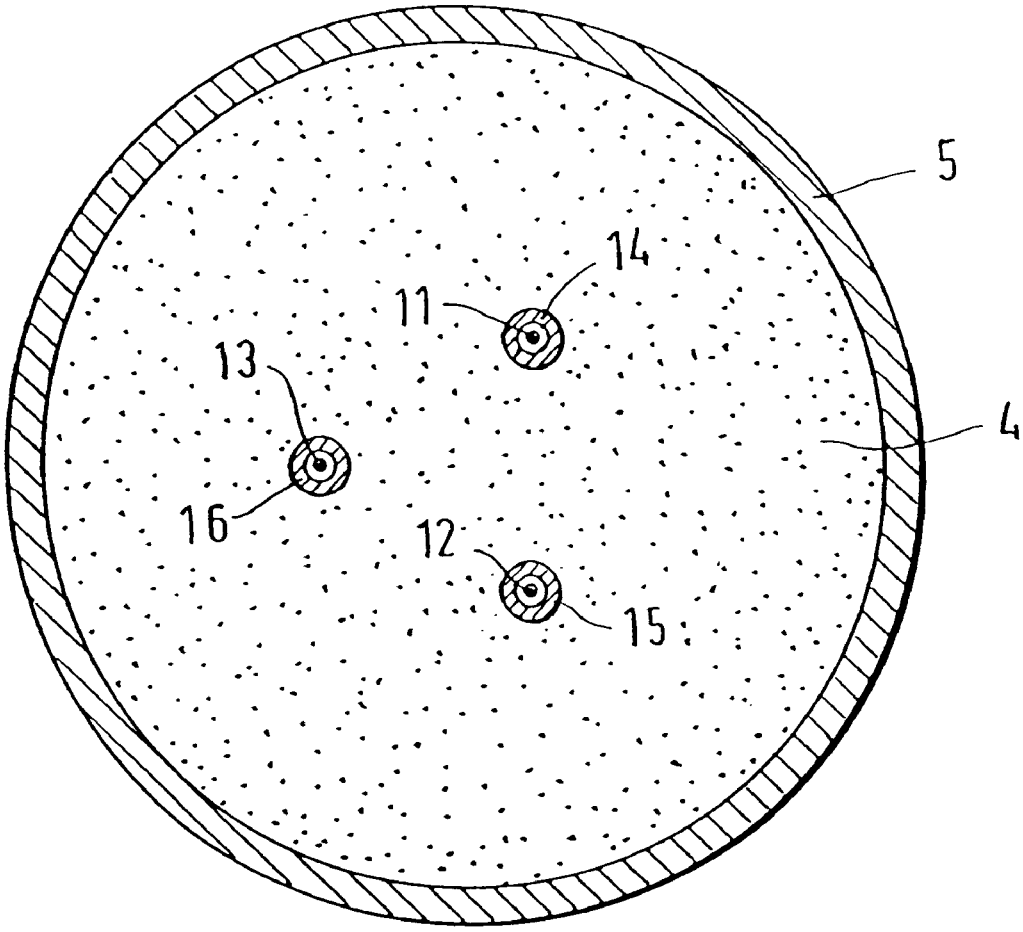
FIG. 2 is a cross-section, in an enlarged representation, through the cartridge of FIG. 1 along the line II—II in FIG. 1.

Referring now to FIG. 1, there is shown a large-caliber cartridge 1, e.g., for firing from a tank gun. For ignition purposes, the cartridge 1 is connected via a switch 2 to a current source 3. For the sake of a clear overview, the corresponding gun in which the cartridge 1 is located is not shown.

The cartridge 1 includes a combustible sleeve or jacket 5, which is filled with propellant-charge powder 4, preferably NENA or DNDA, and a metal sleeve floor or cartridge base 6 at the floor-side or base end of the propellant-charge sleeve 5. In the region of the base 6, the end 7 of the combustible sleeve 5 facing the base 6 is fixed or held in a form-fit between an insulating molded part 8 and the cartridge base 6.

Disposed in the center of the base 6 is a high-voltage electrode 9, which is electrically insulated from the base 6. The electrode 9 is fed through the insulating molded part 8 and is connected to a metal disk 10, which acts as a current distributor, on the surface of part 8.

Three electrically-conductive wires 11–13 are secured to the current distributor 10. Each of the wires 11–13 is guided through a respective tube 14–16 comprising a transparent propellant-charge powder, preferably JA2, and is connected to an annular contact part 18 in the region of the upper end 17, i.e., the end opposite the base end, of the propellant-charge sleeve 5. The contact part 18 in turn will contact the inside wall of the gun, not shown, which wall is connected to ground, potential during firing of the cartridge.

The transparent propellant-charge-powder tubes 14–16 are each provided with a plurality of radial openings 19, which are distributed over the length and circumference of the respective tubes.

The charge structure can be either a bulk charge, or a stacked or compact charge.

For firing the cartridge 1, the switch 2 is closed, and the current source 3, which is provided with a series of charged capacitors (at a voltage of, for example, 40 kV), is discharged within a short time. The discharge current occurring in the process leads to an electrical explosion of the wires 11–13 and the initiation of arc discharges inside the propellant-charge-powder tubes 14–16. The tubes 14–16 are ignited by the arcs and abruptly converted. The propellant-charge gases formed in the process, and the released arc radiation, then effect a rapid and uniform ignition of the propellant-charge powder 4 located in the sleeve 5, which is then converted to gas energy, along with the combustible sleeve 5.

The quantity of energy supplied to an NENA propellant-charge powder 4 by way of the plasma-ignition system also effects a compensation of the influence of the temperature of the propellant-charge powder on the combustion speed, so a projectile to be fired from the corresponding gun has a constant muzzle velocity without causing the maximum permissible useful gas pressure to be exceeded.

This type of temperature compensation with the aid of electrical energy can be omitted when using of a temperature-independent DNDA propellant-charge powder. This reduces the quantity of electrical energy that must be available to the plasma-ignition system.

The invention now being fully described, it will be apparent to one or ordinary skill in the art that many changes and modifications can be made thereto without departing from the spirit and scope of the invention as set forth herein.

What is claimed is:

1. A cartridge with an electrothermal ignition device comprising:

a cartridge including a combustible sleeve that is at least partially filled with a first propellant-charge powder, and a metal base connected to one end of the sleeve and forming the base of the cartridge;

a high-voltage electrode extending through and insulated from the base;

an electrically-conductive wire, which extends axially through the first propellant-charge powder, having a first end connected to the high-voltage electrode and a second end connected to an electrical contact disposed in a forward region of the combustible sleeve for contact with an inner wall of a gun barrel when the cartridge is fired; and, a tube formed of a second propellant-charge powder disposed in the first propellant charge powder along at least an axial portion of the combustible sleeve, and through which the electrically-conductive wire is guided axially with the second propellant-charge powder being an optically transparent propellant-charge powder.

2. The cartridge according to claim 1 including a plurality of tubes and a plurality of said electrically conductive wires extending through respective ones of said tubes and connected between said high voltage electrode and said contact.

3. The cartridge according to claim 1 wherein the contact is an annular contact extending around the sleeve.

4. The cartridge according to claim 1, wherein the second propellant-charge powder is nitrocellulose powder.

5. The cartridge according to claim 4, wherein the second propellant-charge powder is JA2 propellant-charge powder.

6. The cartridge according to claim 1 wherein the first propellant-charge powder is N (2-nitroxy)-nitraminethane propellant-charge powder.

7. The cartridge according to claim 1 wherein the first propellant-charge powder is dinitro-diaza-alkanes propellant-charge powder.

8. The cartridge according to claim 1 wherein the tube formed of the second propellant-charge powder is provided with a plurality of radial openings that are distributed over the tube length and circumference.

9. The cartridge according to claim 2 wherein at least three of said tubes extend axially through the first propellant-charge powder located in the sleeve, with each said tube having a respective one of said conductive wires extending there through and connected between said high-voltage electrode facing the interior of the sleeve, and to which the wires are connected, is formed as a current distributor.

10. The cartridge according to claim 9, wherein the current distributor is a metal disk.

* * * * *